US009475310B2

(12) United States Patent
Sasaki

(10) Patent No.: US 9,475,310 B2
(45) Date of Patent: Oct. 25, 2016

(54) LIQUID EJECTING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 14/489,100

(22) Filed: Sep. 17, 2014

(65) Prior Publication Data

US 2015/0138269 A1 May 21, 2015

(30) Foreign Application Priority Data

Nov. 20, 2013 (JP) ..... 2013-240059

(51) Int. Cl.
*B41J 11/00* (2006.01)
*B41J 2/125* (2006.01)
*B41J 2/01* (2006.01)

(52) U.S. Cl.
CPC ..... *B41J 11/002* (2013.01); *B41J 2/01* (2013.01); *B41J 11/0095* (2013.01)

(58) Field of Classification Search
CPC ..... B41J 11/002; B41J 2/01; B41J 25/308; G03G 15/5029; G03G 15/0189; G03G 2215/2074
USPC ..... 347/8
See application file for complete search history.

(56) References Cited

U.S. PATENT DOCUMENTS 4,668,063 A * 5/1987 Street ..... G03B 35/00 348/E13.012
5,764,251 A * 6/1998 Hashimoto ..... 347/16
5,831,740 A * 11/1998 Terauchi ..... 356/402
6,084,607 A * 7/2000 Matsuda ..... 347/19
7,313,067 B2 * 12/2007 Higashiyama ..... B41J 11/0095 347/105
7,521,260 B2 * 4/2009 Petruno ..... G01N 21/8483 422/402
7,621,615 B2 * 11/2009 Kikuchi ..... B41J 11/009 347/105
7,690,778 B2 * 4/2010 Cai ..... B41J 29/393 347/96

(Continued)

FOREIGN PATENT DOCUMENTS

JP 2001058396 3/2001
JP 2002331648 11/2002

(Continued)

OTHER PUBLICATIONS

European Search Report for Application No. 14193175.8 dated Mar. 30, 2015.

*Primary Examiner* — Matthew Luu
*Assistant Examiner* — Patrick King
(74) *Attorney, Agent, or Firm* — Workman Nydegger

(57) ABSTRACT

A liquid ejecting apparatus includes an ejection unit that ejects a liquid, a medium support unit that has a support face supporting a medium to which the liquid is ejected, an irradiation unit that irradiates the medium with a first electromagnetic wave from an oblique direction with respect to the support face, and a sensor that detects a second electromagnetic wave which is emitted from an irradiation region of the first electromagnetic wave on the support face, in which the sensor is in a position with respect to the irradiation unit which is the same side as an irradiation direction of the first electromagnetic wave, and is arranged in a position where a regular reflection component of the first electromagnetic wave reflected at a peak spot where irradiation energy of the first electromagnetic wave peaks in the irradiation region is not detected.

8 Claims, 8 Drawing Sheets

(56) References Cited

U.S. PATENT DOCUMENTS

| | | | | |
|---|---|---|---|---|
| 7,695,131 | B2 * | 4/2010 | Yun et al. | 347/105 |
| 7,880,931 | B2 * | 2/2011 | Itagaki | H04N 1/60 347/139 |
| 8,469,482 | B2 * | 6/2013 | Pawlik | B41J 11/009 347/101 |
| 8,942,583 | B2 * | 1/2015 | Hoshi | G03G 15/0189 356/445 |
| 2003/0227533 | A1 * | 12/2003 | Yokoi | 347/156 |
| 2005/0110822 | A1 | 5/2005 | Hwang et al. | |
| 2008/0024531 | A1 * | 1/2008 | Bastani | B41J 25/308 347/8 |
| 2011/0069394 | A1 * | 3/2011 | Stelter | G02B 27/2214 359/619 |
| 2011/0249062 | A1 * | 10/2011 | Nakano et al. | 347/37 |
| 2013/0044153 | A1 * | 2/2013 | Sasaki et al. | 347/16 |
| 2013/0216245 | A1 * | 8/2013 | Hoshi | G03G 15/0189 399/45 |

FOREIGN PATENT DOCUMENTS

| | | |
|---|---|---|
| JP | 2006192779 | 7/2006 |
| JP | 2011143626 | 7/2011 |
| JP | 2012-045855 | 3/2012 |
| JP | 2012045855 | 3/2012 |
| JP | 2013-039708 | 2/2013 |
| JP | 2013-039737 | 2/2013 |
| WO | 2009/127261 | 10/2009 |

* cited by examiner

LIQUID EJECTING APPARATUS

BACKGROUND

1. Technical Field

The present invention relates to a liquid ejecting apparatus including an ejection unit that ejects a liquid with respect to a medium which is supported by a support face, an irradiation unit that dries the liquid by irradiating an electromagnetic wave with respect to the medium on the support face, and a sensor that measures a temperature of the medium by detecting the electromagnetic wave which is emitted from the medium on the support face.

2. Related Art

From the related art, a liquid ejecting apparatus including a heating unit that dries a liquid which is ejected with respect to a medium by irradiating with an electromagnetic wave with respect to the medium which is supported on a support face, is known as shown in JP-A-2012-45855.

Furthermore, in a printing apparatus which is disclosed in JP-A-2012-45855, there is described a purport that two sensors which obtain information relating to a temperature of the medium are arranged. The temperatures of two points of an upstream side and a downstream side of a pinch roller are measured by the two sensors, and a control of the heating unit is performed, on the basis of the measured temperature information.

Moreover, there is described the purport that using one sensor, the temperature of the other point may be estimated by measuring the temperature of any one of the two points, or one sensor which measures a temperature distribution of a wide range including the two points may be arranged.

However, in JP-A-2012-45855, a position of the heating unit with respect to the pinch roller is described, but any kind of a positional relationship between the sensor and the heating unit, is not described.

Accordingly, if the sensor is in a position where a reflection component reflecting the electromagnetic wave (hereinafter, referred to as a first electromagnetic wave) which is irradiated from an irradiation unit in the medium, is detected, in addition to the electromagnetic wave (hereinafter, referred to as a second electromagnetic wave) which is emitted from the medium to be originally detected, the reflection component of the first electromagnetic wave which is not necessary, is also detected.

In particular, if a reflection component which is regular-reflected at a spot (hereinafter, referred to as a peak spot) where irradiation energy of the first electromagnetic wave peaks, is detected, an influence thereof is large, an error in a case of calculating the temperature of the medium becomes large by a noise thereof, variation occurs in the measurement temperature, and thereby, accuracy of a measurement temperature is worsened.

SUMMARY

An advantage of some aspects of the invention is to provide a liquid ejecting apparatus that has a positional relationship between an irradiation unit and a sensor which is laid out so as to be able to accurately detect a second electromagnetic wave which is emitted from a medium, by reducing an influence of a reflection component of a first electromagnetic wave which is irradiated from the irradiation unit.

According to an aspect of the invention, there is provided a liquid ejecting apparatus including a medium support unit that has a support face supporting a medium to which a liquid is ejected, an irradiation unit that irradiates the medium with a first electromagnetic wave from an oblique direction with respect to the support face, and a sensor that detects a second electromagnetic wave which is emitted from an irradiation region of the first electromagnetic wave on the support face, in which the sensor is in a position with respect to the irradiation unit which is the same side as an irradiation direction of the first electromagnetic wave, and is arranged in a position where a regular reflection component of the first electromagnetic wave reflected at a peak spot where irradiation energy of the first electromagnetic wave peaks in the irradiation region is not detected.

Here, the "oblique direction" means the direction which meets both the direction parallel to the support face and the direction perpendicular to the support face, and intersects at a predetermined tilt angle with respect to the support face.

Furthermore, the "position of the irradiation unit" in the "position with respect to the irradiation unit which is the same side as an irradiation direction of the first electromagnetic wave", does not mean the positions of the whole configuration members of the irradiation unit in the irradiation direction of the first electromagnetic wave, but means the position of an irradiation source of the electromagnetic wave in the irradiation unit. Accordingly, within the configuration members of the irradiation unit, there is no problem in the positions of the configuration members except for the irradiation source such as a housing and a support member of the housing.

In this case, since the sensor is set in the position with respect to the irradiation unit which is the deviated position of the same side as the irradiation direction of the first electromagnetic wave, a reduction in a detection amount of the second electromagnetic wave which becomes the problem in a case of setting the position of the sensor on the side opposite to the irradiation direction, and a decrease of detection accuracy of the sensor caused by this, are prevented. Moreover, it is possible to provide the compact liquid ejecting apparatus by preventing an enlargement of a product size.

Furthermore, by setting a space position of the sensor in the position where the regular reflection component of the first electromagnetic wave reflected at the peak spot is not detected, variation of the detection accuracy of the sensor which occurs by being largely influenced by the regular reflection component of the first electromagnetic wave as a noise, is decreased, and it is possible to execute an accurate temperature measurement of the medium by improving reliability of the sensor.

Here, the "first electromagnetic wave" means the electromagnetic wave which is directly irradiated onto the support face from the irradiation unit, or the electromagnetic wave which is irradiated onto the support face through a reflector (reflection plate). When the medium is on the support face, the "first electromagnetic wave" means the electromagnetic wave which is irradiated with respect to the medium.

Moreover, the "second electromagnetic wave" means a secondary electromagnetic wave which is emitted from the region (region in the support face, or region in the medium) receiving the irradiation of the first electromagnetic wave, in the irradiation region of the first electromagnetic wave.

Furthermore, the "peak spot" means the spot among the irradiation region where the irradiation energy of the first electromagnetic wave which is irradiated onto the support face, peaks. When the medium is on the support face, the "peak spot" means the spot among the irradiation region where the irradiation energy of the first electromagnetic wave which is irradiated with respect to the medium peaks.

In the liquid ejecting apparatus, the sensor may be arranged between the irradiation unit and the peak spot.

In this case, since the position of the sensor is the position approaching the irradiation unit side which is less likely to be influenced by the reflection component of the first electromagnetic wave, it is possible to effectively decrease the influence of the reflection component of the first electromagnetic wave which is reflected from other region except for the peak spot in the irradiation region.

The liquid ejecting apparatus may further include a transport unit that transports the medium toward a downstream side from an upstream side in a transport direction of the medium, in which the irradiation unit is positioned on the downstream side in the transport direction with respect to an ejection unit, and the irradiation region of the first electromagnetic wave is positioned on the upstream side in the transport direction from the irradiation unit.

In this case, since the irradiation unit is positioned on the downstream side in the transport direction with respect to the ejection unit, and the irradiation region of the first electromagnetic wave is positioned on the upstream side in the transport direction from the irradiation unit, it is possible to install the irradiation unit effectively utilizing the space within the liquid ejecting apparatus.

The liquid ejecting apparatus may further include a transport unit that transports the medium toward a downstream side from an upstream side in a transport direction of the medium, in which the irradiation unit is positioned on the upstream side in the transport direction with respect to an ejection unit, and the irradiation region of the first electromagnetic wave is positioned on the downstream side in the transport direction from the irradiation unit.

In this case, since the irradiation unit is positioned on the upstream side in the transport direction with respect to the ejection unit, and the irradiation region of the first electromagnetic wave is positioned on the downstream side in the transport direction from the irradiation unit, it is possible to perform preheating of the medium before the liquid is ejected, and it is also possible to dry the liquid which is ejected further toward the medium, using the first electromagnetic wave which is irradiated from the irradiation unit.

In the liquid ejecting apparatus, the ejection unit ejects the liquid while reciprocating in a direction intersecting with the transport direction, and the liquid ejecting apparatus may further include a blowing unit that blows a wind with respect to the irradiation region of the first electromagnetic wave on the support face.

In this case, since the drying of the liquid which is ejected to the medium, can be performed with both the heating by the first electromagnetic wave which is irradiated from the irradiation unit, and the wind which is blown from the blowing unit, it is possible to promote the drying of the liquid.

Moreover, in a portion where the ejection unit is present on an upward side in the irradiation region, the wind which is blown from the blowing unit, is inhibited. Accordingly, it is possible to decrease an occurrence of deviation or the like of a landing position caused by the blowing of the liquid which is ejected from the ejection unit.

In the liquid ejecting apparatus, a detection face of the sensor may be arranged so as to face a front with respect to the irradiation region of the first electromagnetic wave.

The sensor is the exact front opposing to a measurement target, and has the highest detection accuracy, and the detection accuracy is gradually lowered in accordance with separation from the exact front. Accordingly, if the detection face of the sensor is arranged so as to face the front with respect to the irradiation region of the first electromagnetic wave as the aspect, the detection accuracy of the second electromagnetic wave is improved by the sensor, and it is possible to accurately measure the temperature of the medium on the support face.

In the liquid ejecting apparatus, the sensor may have a viewing angle which is 6 degrees to 7 degrees, and may have a distance to the support face which is 150 mm or less in a second direction orthogonal to the support face.

In this case, since a detection range of the sensor can be set in a predetermined range of the irradiation region of the first electromagnetic wave, it is possible to accurately measure the temperature of the medium in the portion whose the temperature is increased by being heated by the irradiation of the first electromagnetic wave. Moreover, according to the setting of the aspect, the detection range of the sensor can be set in a preferable range, and it is possible to decrease the variation of a temperature distribution resulting from a difference of the position on the medium.

In the liquid ejecting apparatus, the irradiation unit may have a distance to the support face which is in a range of 80 mm to 110 mm in the second direction orthogonal to the support face.

Here, the "second direction" means the direction orthogonal to a flat face where the support face of the medium support unit is formed.

In this case, an irradiation output of the first electromagnetic wave which is irradiated from the irradiation unit, can be kept in an appropriate range, and it is possible to decrease unevenness or the like in the drying of the liquid, by reducing the variation of the temperature of the medium within an irradiation range of the first electromagnetic wave.

According to another aspect of the invention, there is a provided a liquid ejecting apparatus including an ejection unit that ejects a liquid, a medium support unit that has a support face supporting a medium to which the liquid is ejected, an irradiation unit that irradiates the medium with a first electromagnetic wave, and a sensor that detects a second electromagnetic wave which is emitted from an irradiation region of the first electromagnetic wave on the support face, in which when a direction along a transport direction of the medium in the support face is a first direction, a position in the first direction of a peak spot where irradiation energy of the first electromagnetic wave which is irradiated in the support face peaks, is different from a position in the first direction of the irradiation unit, and the sensor is on the same side as the peak spot with respect to the irradiation unit in the first direction, and is arranged in a position where a regular reflection component of the first electromagnetic wave reflected at the peak spot is not detected.

The "position in the first direction of the irradiation unit" does not mean the positions of the whole configuration members of the irradiation unit in the first direction, but means the position of the irradiation source of the electromagnetic wave in the irradiation unit in the first direction. Accordingly, within the configuration members of the irradiation unit, there is no problem in the positions of the configuration members except for the irradiation source such as the housing and the support member of the housing.

In this case, since the sensor is on the same side as the peak spot with respect to the irradiation unit in the first direction, and is arranged in the position where the regular reflection component of the first electromagnetic wave reflected at the peak spot is not detected, it is possible to accurately detect the second electromagnetic wave which is emitted from the medium, by reducing the influence of the reflection component of the first electromagnetic wave which is irradiated from the irradiation unit. That is, it is possible to suppress the unevenness in the heating with respect to the medium by the first electromagnetic wave, by accurately performing the temperature measurement of the medium, and accordingly, it is possible to realize the appropriate drying of the liquid. Furthermore, it is possible to provide the compact liquid ejecting apparatus by preventing the enlargement of the product size.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1, see FIG. 1 to FIG. 9

Hereinafter, a liquid ejecting apparatus according to Embodiment 1 of the invention, will be described in detail, with reference to accompanying drawings.

First, (1) an outline configuration of the liquid ejecting apparatus according to Embodiment 1, will be described, and, subsequently, an order of (2) a positional relationship between each of configuration members of the liquid ejecting apparatus which are main portions of the invention, (3) a relationship between a tilt angle of an irradiation unit and a temperature distribution of a medium, and (4) an operation aspect of the liquid ejecting apparatus, will be described in order.

Figure 1:
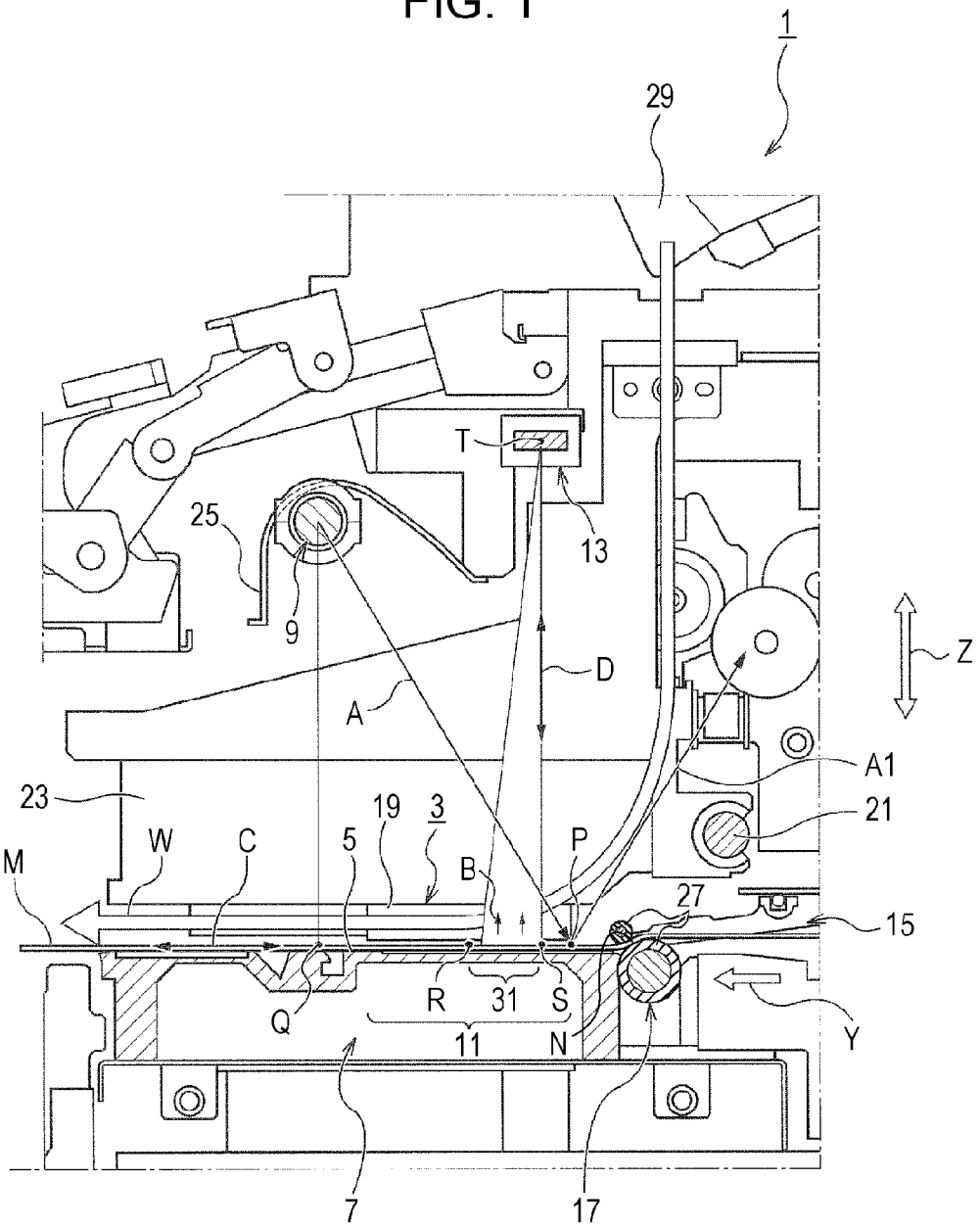
FIG. 1 is a side cross-sectional view representing a liquid ejecting apparatus according to Embodiment 1 of the invention.
Figure 2:
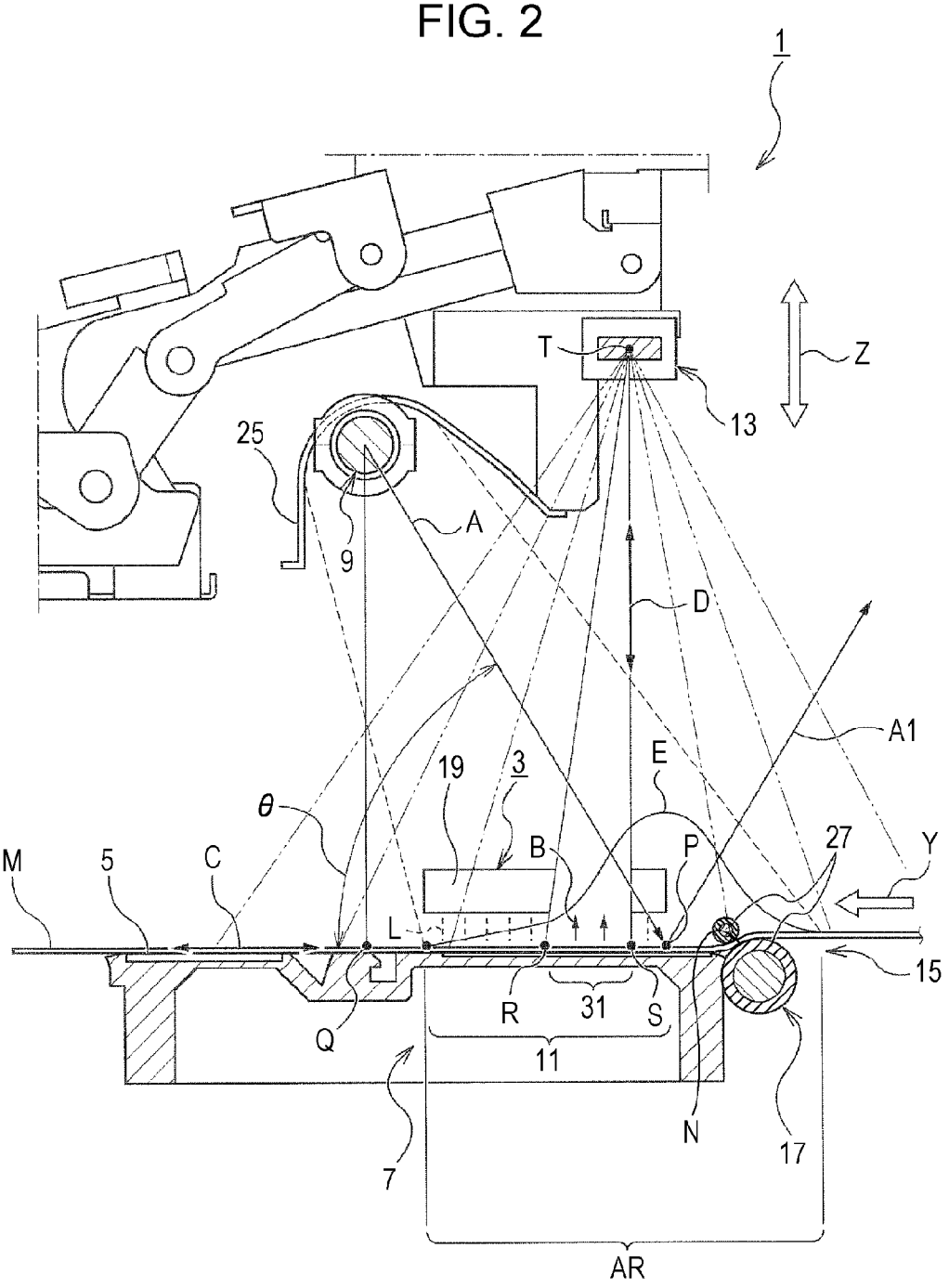
FIG. 2 is an enlarged side cross-sectional view of a main portion representing the liquid ejecting apparatus according to Embodiment 1 of the invention.

(1) Outline Configuration of Liquid Ejecting Apparatus, see FIG. 1 and FIG. 2

A liquid ejecting apparatus 1 according to Embodiment 1, is basically configured to include an ejection unit 3 that ejects a liquid L, a medium support unit 7 that has a support face 5 supporting a medium M to which the liquid L is ejected, an irradiation unit 9 that irradiates the medium M with a first electromagnetic wave A, and a sensor 13 that detects a second electromagnetic wave B which is emitted from an irradiation region AR where irradiation energy E (see FIG. 2) of the first electromagnetic wave A irradiated with respect to the medium M on the support face 5, is irradiated.

Here, when no medium M is on the support face 5, the irradiation region AR is the region where the first electromagnetic wave A is irradiated in the support face 5. Moreover, when the medium M is on the support face 5, the irradiation region AR is the region where the first electromagnetic wave A is irradiated in the medium M. Furthermore, in FIG. 2, an irradiation range of the first electromagnetic wave is temporarily determined by a dotted line which is extended from a reflector 25, and an example of the irradiation region AR is shown. However, the irradiation region AR is not limited to the region which is shown in the drawing, and is determined according to the irradiation range of the first electromagnetic wave A.

Therefore, the liquid ejecting apparatus 1 according to Embodiment 1, further includes a transport unit 17 that transports the medium M toward a downstream side from an upstream side of a transport direction Y in a medium transport path 15 passing on the support face 5, and in FIG. 1, an ink jet printer including the various members, is shown as an example of the liquid ejecting apparatus 1 in the drawing.

Accordingly, in Embodiment 1, the liquid L is an ink, a liquid component of the ink is heated and dried by the irradiation of the first electromagnetic wave A, and thereby, a pigment component of the ink is fixed on a surface of the medium M as described later.

Furthermore, the ejection unit 3 is configured to include an ejection head 19 that directly ejects the liquid L, and a carriage 23 that reciprocates along a carriage guide shaft 21 in a state of mounting the ejection head 19 as an example on a lower face, using a width direction X intersecting with the transport direction Y of the medium M, as a movement direction. In FIG. 1 and FIG. 2, a reference numeral 11 shows a liquid ejection region in the transport direction Y by the ejection head 19 of the ejection unit 3.

Moreover, as the medium M, in addition to paper and film having various kinds of thickness, a CD, a DVD, fabric which is a textile product such as cloth and textile using cotton, hemp, silk, a mixture of these, or the like as raw yarn, and the like, are included.

The medium support unit 7 is a support member of the medium M that is arranged in a position opposing to an ejection face of the ejection head 19, and is the member that has a role defining a gap between the support face 5 of the medium support unit 7 and the ejection face of the ejection head 19.

The first electromagnetic wave A means the electromagnetic wave including infrared rays, far infrared rays, and visible light that are irradiated with respect to the medium M on the support face 5, directly from the irradiation unit 9, or through the reflector 25 which is a reflection plate. In Embodiment 1, the infrared rays are used as an example, and an infrared heater is employed as the irradiation unit 9.

Furthermore, the second electromagnetic wave B which is emitted from the irradiation region AR, is a secondary electromagnetic wave that is naturally emitted from the region (region in the support face 5 or region in the medium M) receiving the irradiation of the first electromagnetic wave A. In other words, radiant energy from the irradiation region AR corresponds to the second electromagnetic wave B. Consequently, the second electromagnetic wave B is different from the first electromagnetic wave A which is reflected at the surface of the irradiation region AR. The sensor 13 makes the second electromagnetic wave B a detection target.

The transport unit 17 is configured to include the medium transport path 15 that is formed on the inside of the liquid ejecting apparatus 1, a guide member such as a guide roller or the like that guides the transport of the medium M in the medium transport path 15, and is not shown, and a member for transporting the medium M including a pair of nip rollers 27 that sends the medium M into the gap between the ejection head 19 and the medium support unit 7.

Moreover, in Embodiment 1, with respect to the irradiation region AR of the first electromagnetic wave A, a drying fan as a blowing unit 29 that blows a wind W toward a downstream side from an upstream side in the transport direction Y of the medium M by the transport unit 17, is arranged in an upward position in a height direction Z, as shown in FIG. 1. Specifically, the upward position is the position which is more upward than the carriage 23 in the height direction Z. Furthermore, the blowing unit 29 has the role promoting the drying of the liquid L which is ejected to the medium M, by making the wind W flow as shown by an arrow in FIG. 1, so as to come into contact with the irradiation region AR.

Moreover, in the portion where the ejection unit 3 is present on the upward side in the irradiation region AR, the wind W which is blown from the blowing unit 29, is inhibited. Accordingly, it is possible to decrease an occurrence of deviation or the like of a landing position caused by the blowing of the liquid L which is ejected from the ejection unit 3. Here, a term in which the wind W is inhibited, means that the wind W is completely blocked, or an air volume is decreased. Furthermore, if the blowing unit 29 blows the wind W with respect to the irradiation region AR, an installation location of the blowing unit 29, and a direction of the wind W may be any direction. For example, it may be configured to blow the wind W toward the upstream side from the downstream side in the transport direction Y.

(2) Position Relationship between Each of Configuration Members of Liquid Ejecting Apparatus, see FIG. 2 to FIG. 5

The liquid ejecting apparatus 1 according to Embodiment 1, has features in an layout of the configuration members described above and the positional relationship between the tilt angle and the like. Hereinafter, specifically, the positional relationship between each of the configuration members of the liquid ejecting apparatus 1, will be described. Here, the direction along the transport direction Y in the support face 5, is a first direction C, and the direction orthogonal to the support face 5, is a second direction D. Furthermore, the first direction C is the same direction as the transport direction Y, in at least the support face 5.

At this time, in the liquid ejecting apparatus 1, the relationship between an arrangement position of the irradiation unit 9, and the first electromagnetic wave A which is irradiated from the irradiation unit 9, is made as follows. The position in the first direction C of a peak spot P where the irradiation energy E of the first electromagnetic wave A which is irradiated with respect to the medium M on the support face 5 peaks, is different from a position Q in the first direction C of the irradiation unit 9. Furthermore, in the support face 5, the peak spot P means the spot where the irradiation energy E of the first electromagnetic wave A which is irradiated to the support face 5 peaks. Moreover, when the medium M is on the support face 5, in the medium M, the peak spot P means the spot where the irradiation energy E of the first electromagnetic wave A which is irradiated with respect to the medium M peaks.

Therefore, the sensor 13 is arranged in the position where a regular reflection component A1 of the first electromagnetic wave A reflected at the peak spot P is not detected. Here, the "regular reflection component" is the component reflecting the electromagnetic wave at a reflection angle equal to an incidence angle, among the electromagnetic wave which is reflected in the irradiation region AR. Furthermore, the component reflecting the electromagnetic wave at the reflection angle different from the incidence angle, is referred to as a diffusion reflection component (or irregular reflection component). When the irradiation region AR is a shiny face, the regular reflection component A1 has the high energy in comparison with the diffusion reflection component. The support face 5 is made of metal in Embodiment 1, and the regular reflection component A1 of the first electromagnetic wave A reflected at the peak spot P, has high possibility that the energy is highest among the reflection components of the first electromagnetic wave A. Consequently, the sensor 13 is made so as not to detect at least the regular reflection component A1, and thereby, detection accuracy of the second electromagnetic wave B is improved.

At this time, if the position in the first direction C of the sensor 13, is a position S, the position S is positioned on the same side as the peak spot P with respect to the position Q of the irradiation unit 9, in the first direction C. By being the position S on the same side as the peak spot P in the first direction C, the electromagnetic wave which is emitted from the position close to the peak spot P, can be detected. Furthermore, the term in which the components of the electromagnetic wave are "not detected" can be expressed that the components of the electromagnetic wave are "not picked out", in other words.

Specifically, by adjusting the layout of the configuration members described hereinafter, and a tilt angle θ of the irradiation unit 9, so as to irradiate the medium with the first electromagnetic wave A from an oblique direction with respect to the medium M on the support face 5, or the support face 5, the position S of the sensor 13 deviates to the same side as the irradiation direction of the first electromagnetic wave A. Here, the term of the oblique direction means the direction which meets both the first direction C and the second direction D, and intersects at a predetermined tilt angle θ with respect to the support face 5. In other words, the oblique direction is the direction which meets both the direction parallel to the support face 5 and the direction perpendicular to the support face 5.

Moreover, in Embodiment 1, the position S in the first direction C of the sensor 13 is set so as to position between the position Q in the first direction C of the irradiation unit 9 and the position of the peak spot P. In other words, the sensor 13 is arranged between the irradiation unit 9 and the peak spot P. Furthermore, the position Q in the first direction C of the irradiation unit 9, does not mean the positions of the whole configuration members of the irradiation unit 9 in the first direction C, but means the position of the irradiation source of the electromagnetic wave in the irradiation unit 9 in the first direction C. Accordingly, within the configuration members of the irradiation unit 9, there is no problem in the positions of the configuration members except for the irradiation source such as the housing and the support member of the housing.

In the configuration described above, since the position of the sensor 13 is the position approaching the irradiation unit 9 side which is less likely to be influenced by the reflection component of the first electromagnetic wave A, it is possible to effectively decrease the influence of the reflection component of the first electromagnetic wave A which is reflected from other region except for the peak spot P in the irradiation region AR.

In Embodiment 1, the position Q in the first direction C of the irradiation unit 9, is set so as to position on the downstream side in the transport direction Y of the medium M with respect to a position R in the first direction C of the ejection unit 3, and the irradiation region AR of the first electromagnetic wave A with respect to the medium M on the support face 5, is set so as to position on the upstream side in the transport direction Y of the medium M with respect to the position Q in the first direction C of the irradiation unit 9. Furthermore, the position R in the first direction C of the ejection unit 3, is a center point in the first direction C of the ejection unit 3.

Moreover, in Embodiment 1, a detection face of the sensor 13 is arranged so as to face a front with respect to the irradiation region AR of the first electromagnetic wave A with respect to the medium M on the support face 5. Here, the front does not indicate only the exact front. As an example, the state where the detection face is not inclined with respect to the support face 5, is in the range that includes the exact front, and is inclined up to 3 degrees in absolute value from the state. The sensor 13 is the exact front opposing to a measurement target, and has the highest detection accuracy, and the detection accuracy is gradually lowered according to separating from the exact front. Accordingly, if the detection face of the sensor 13 is arranged so as to face the front with respect to the irradiation region AR of the first electromagnetic wave A as the aspect, the detection accuracy of the second electromagnetic wave B is improved by the sensor 13, and it is possible to accurately measure the temperature of the medium M on the support face 5.

Figure 3:
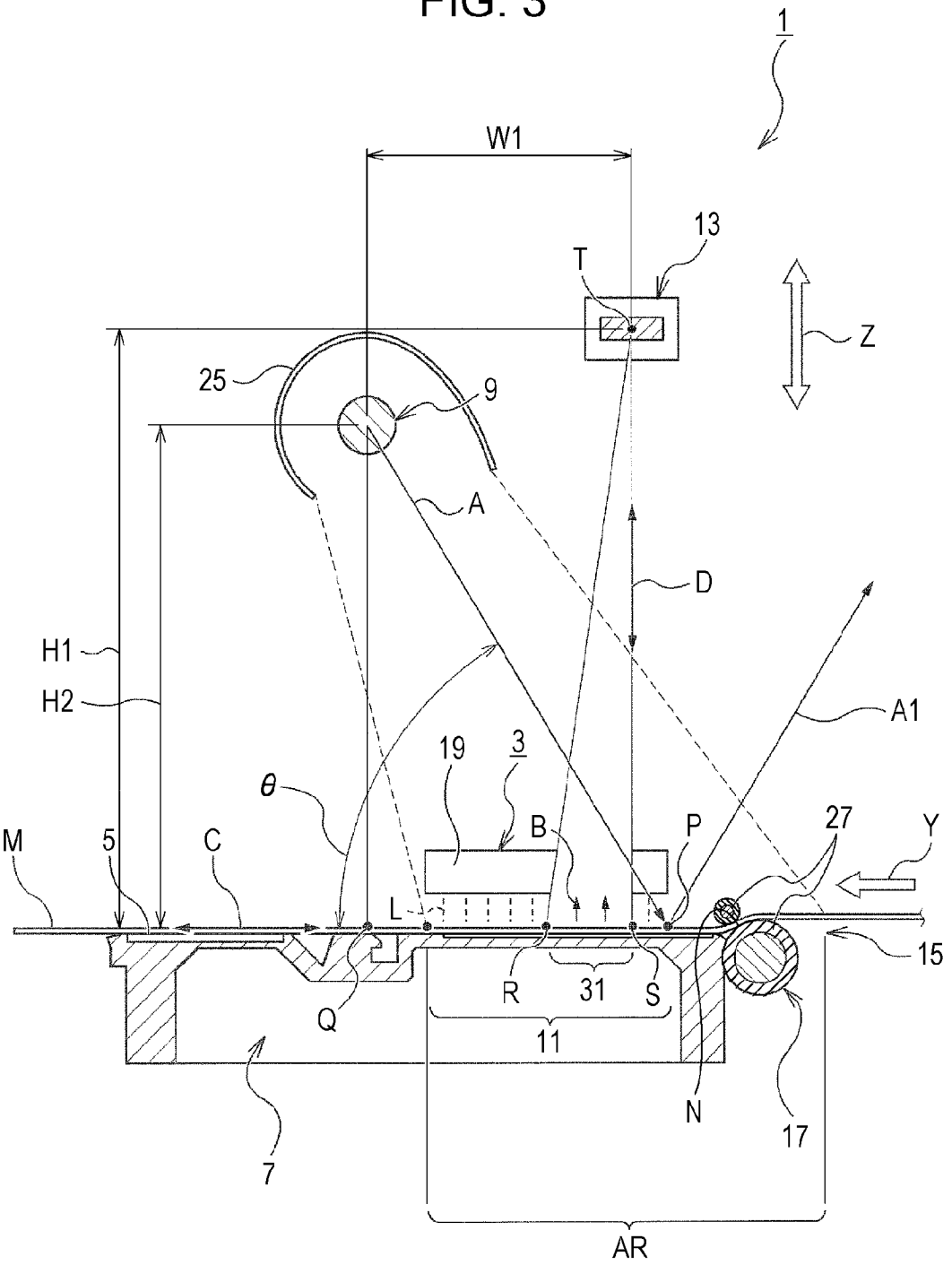
FIG. 3 is a side cross-sectional view schematically representing a positional relationship between each of configuration members of the liquid ejecting apparatus according to Embodiment 1 of the invention.

Therefore, in Embodiment 1, the sensor 13 having a viewing angle of 6 degrees to 7 degrees, is used as an example. Here, as shown in FIG. 3, the position in the second direction D of the sensor 13 is a position T, and the distance between the sensor 13 and the support face 5 in the second direction D is a distance H1. At this time, the distance H1 is set to 150 mm or less, as an example. In other words, the position T of the sensor 13 is set in the position where the distance H1 is 150 mm or less. As described above, the second direction D means the direction orthogonal to a flat face where the support face 5 of the medium support unit 7 is formed.

According to the configuration described above, since a detection range 31 of the sensor 13 can be set in a predetermined range of the irradiation region AR of the first electromagnetic wave A, it is possible to accurately measure the temperature of the medium of M in the portion whose the temperature is increased by being heated by the irradiation of the first electromagnetic wave A. Furthermore, according to the setting of the aspect, the detection range 31 of the sensor 13 can be set in a preferable range, and it is possible to decrease the variation of the temperature distribution resulting from a difference of the position on the medium M.

Moreover, a distance H2 between the irradiation unit 9 and the support face 5 in the second direction D orthogonal to the support face 5, is set in the range of 80 mm to 110 mm, as an example, and a distance W1 between the position S in the first direction C of the sensor 13, and the position Q in the first direction C of the irradiation unit 9, is set to 65 mm or less, as one example. According to the configuration described above, an irradiation output of the first electromagnetic wave A which is irradiated from the irradiation unit 9, can be kept in an appropriate range, and it is possible to decrease unevenness or the like in the drying of the liquid L, by reducing the variation of the temperature of the medium M within the irradiation range of the first electromagnetic wave A.

Additionally, in Embodiment 1, the tilt angle θ with respect to the support face 5 of the first electromagnetic wave A which is irradiated from the irradiation unit 9, is set to 65 degrees or less, as one example. Furthermore, this point will be described specifically in the next paragraph.

Figure 4:
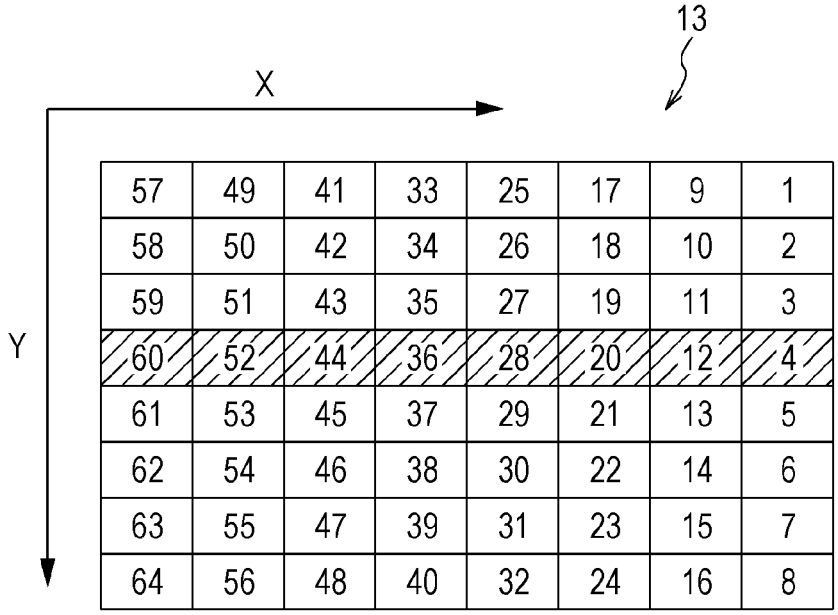
FIG. 4 is an explanatory diagram representing the number of channels of a sensor and a detection range to be used in the liquid ejecting apparatus according to Embodiment 1 of the invention.

Therefore, by accepting the positional relationship between each of the configuration members, as shown in FIG. 4, when the sensor 13 having total 64 channels which are 8 in the width direction X and 8 in the transport direction Y, is used, as a detection face, 8 channels in the vicinity of the middle in the transport direction Y which is shown by a slant line in FIG. 4, are used as an example. In other words, among the channels of the sensor 13, a portion of the channels is non-used. The detection of the second electromagnetic wave B is performed by non-using the portion of the channels, and thereby, the possibility to detect the regular reflection components A1 reflected at the peak spot P in the first electromagnetic wave A, can be further decreased. Specifically, even when the regular reflection component A1 hits the portion of the detection face, if the channel corresponding to the portion which is hit by the regular reflection component A1, is the channel in non-use, the influence of the reflection component of the first electromagnetic wave A which is irradiated from the irradiation unit 9, is reduced. Therefore, by squeezing the channel in use, the influence of the reflection component of the first electromagnetic wave A, is further reduced, and it is possible to accurately detect the second electromagnetic wave B which is emitted from the medium M.

Figure 5:
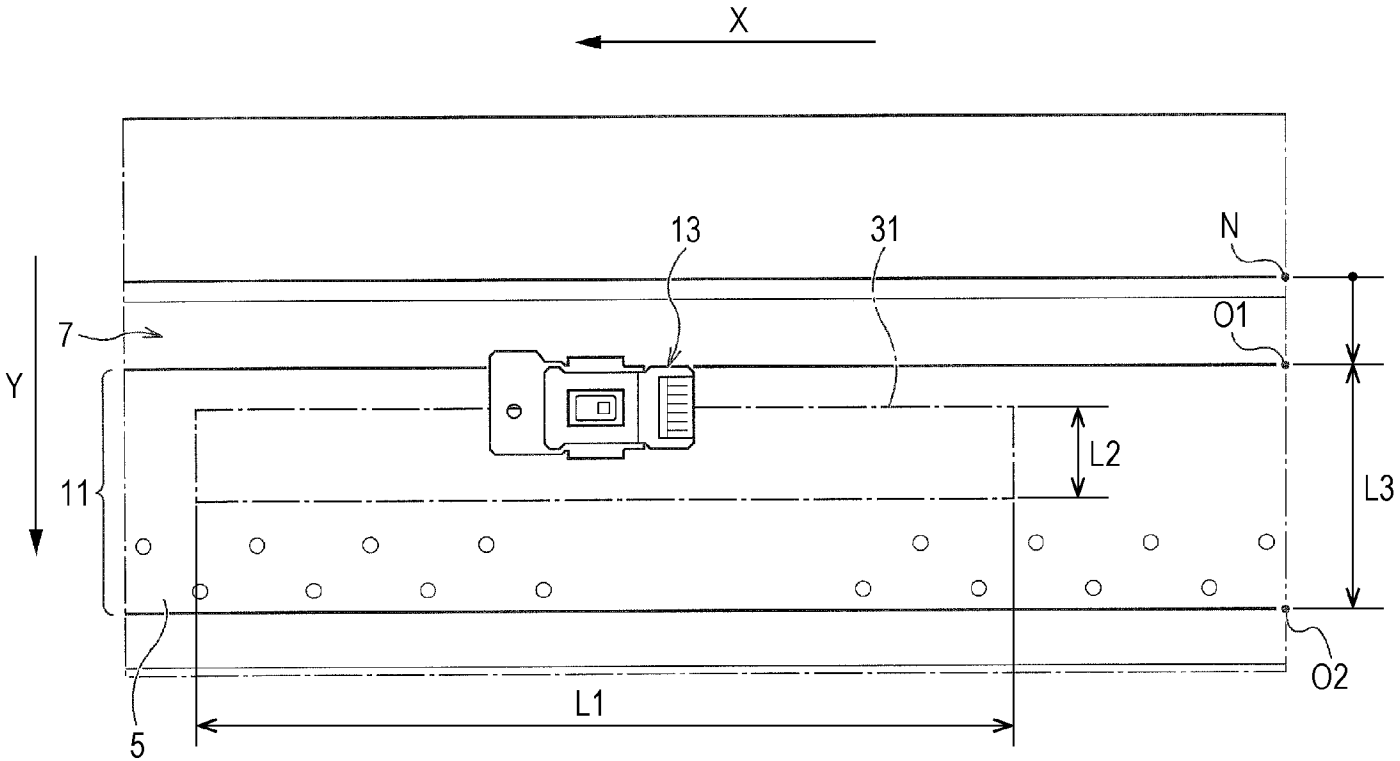
FIG. 5 is a plan view representing the detection range of the sensor and an irradiation region of a first electromagnetic wave of the liquid ejecting apparatus according to Embodiment 1 of the invention.

FIG. 5 shows the detection range 31 of the sensor 13 in the case of using the 8 channels which are shown by the slant line in FIG. 4. A length L1 in the width direction X of the detection range 31, is set to approximately 183 mm, as an example, and a length L2 in the transport direction Y is set to approximately 20 mm, as an example. At this time, the position T in the second direction D of the sensor 13, is set in the position where the distance H1 between the sensor 13 and the support face 5 in the second direction D, is set to approximately 130 mm.

Moreover, an ejection start position O1 of the liquid L by the ejection head 19 of the ejection unit 3 within the irradiation region AR of the first electromagnetic wave A, is the position of approximately 20 mm from a nip spot N of the nip roller 27, an ejection end position O2 of the liquid L by the ejection unit 3 within the irradiation region AR of the first electromagnetic wave A, is approximately 75 mm from the nip spot N of the nip roller 27, and a length L3 of the liquid ejection region 11 by the ejection head 19 within the irradiation region AR of the first electromagnetic wave A, is approximately 55 mm, as an example.

(3) Relationship between Tilt Angle of Irradiation Unit and Temperature Distribution of Medium, see FIG. 6 to FIG. 9

Next, the relationship between the tilt angle θ of the irradiation unit 9 and the temperature distribution of the medium M, will be simply described, on the basis of graphs which are shown in FIG. 6 to FIG. 9. The graphs which are shown in FIG. 6 to FIG. 9, are the graphs which are obtained by inspecting what kind of difference is seen between the temperature of the medium M and a feed length (position in the transport direction Y) of the medium M, if the tilt angle θ of the irradiation unit 9 is changed. A vertical axis of the graph is the temperature of the medium M, and a horizontal axis is the position in the transport direction Y.

Moreover, as a condition to perform the inspection, the medium M is in a stationary state, and the position on the upstream side in the transport direction Y from the nip spot N, is assumed as a measurement start point. The horizontal axes of the graphs which are shown in FIG. 6 to FIG. 9, make the measurement start point an original point (length 0 m). Furthermore, the measurement start point can be arbitrarily determined. In Embodiment 1, the measurement is performed in the state where the nip spot N is in the position whose the position in the transport direction Y is approximately 40 mm from the measurement start point, the ejection start position O1 of the ejection unit 3 within the irradiation region AR of the first electromagnetic wave A, is the position of approximately 15 mm from the nip spot N, and the length L3 of the liquid ejection region 11 by the ejection head 19 within the irradiation region AR of the first electromagnetic wave A, is set to approximately 56 mm.

Figure 6:
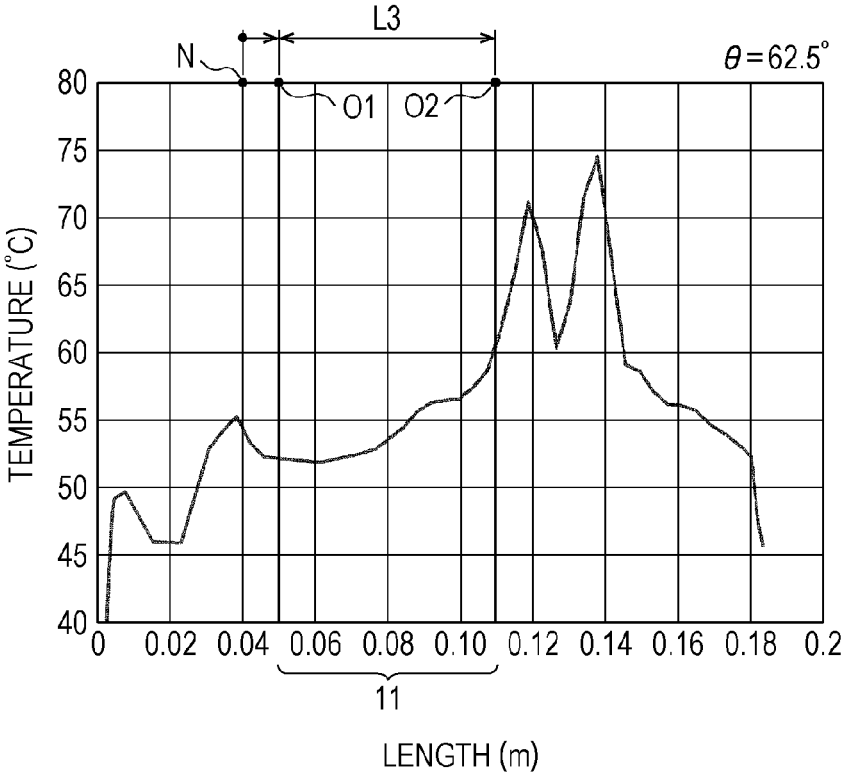
FIG. 6 is a graph representing a relationship between a feed length of a medium and a temperature distribution of the medium at the time of setting a tilt angle of an irradiation unit at an initial value in the liquid ejecting apparatus according to Embodiment 1 of the invention.

First, when the tilt angle θ of the first electromagnetic wave A is set to 62.5 degrees as an initial value, the temperature distribution of the medium M within the liquid ejection region 11 is from approximately 52 degrees to approximately 61 degrees, as shown in FIG. 6, and the variation of the temperature distribution of approximately 9 degrees, is confirmed.

Figure 7:
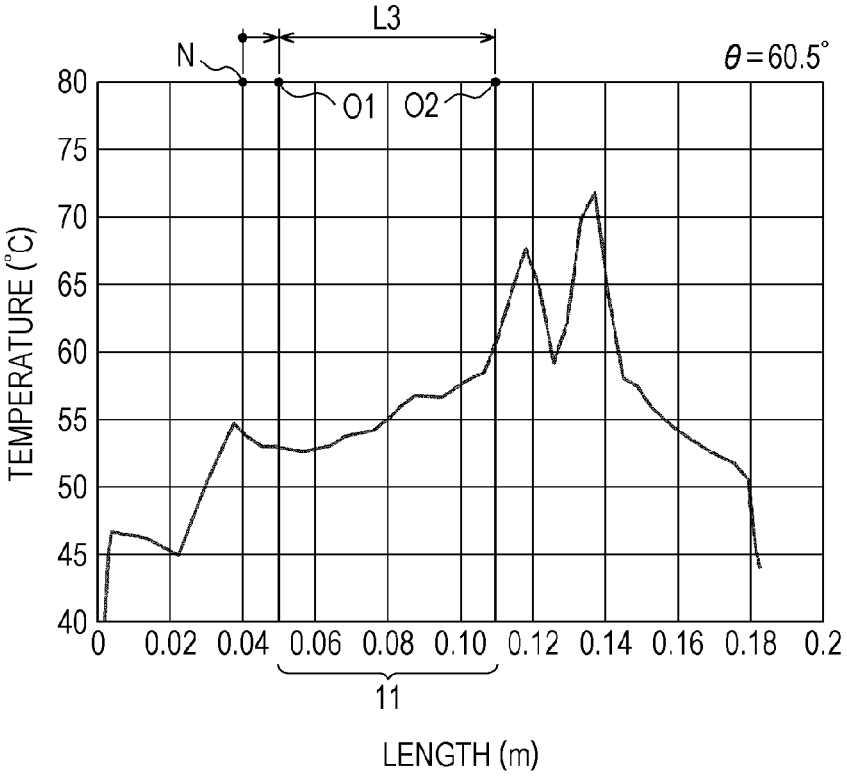
FIG. 7 is a graph representing the relationship between the feed length of the medium and the temperature distribution of the medium at the time of lowering the tilt angle of the irradiation unit by 2 degrees from the initial value, as above.

Next, when the tilt angle θ of the first electromagnetic wave A is set to 60.5 degrees lowering by 2 degrees from the initial value, the temperature distribution of the medium M within the liquid ejection region 11 is from approximately 52.5 degrees to approximately 60 degrees, as shown in FIG. 7, and the variation of the temperature distribution of approximately 7.5 degrees, is confirmed.

Figure 8:
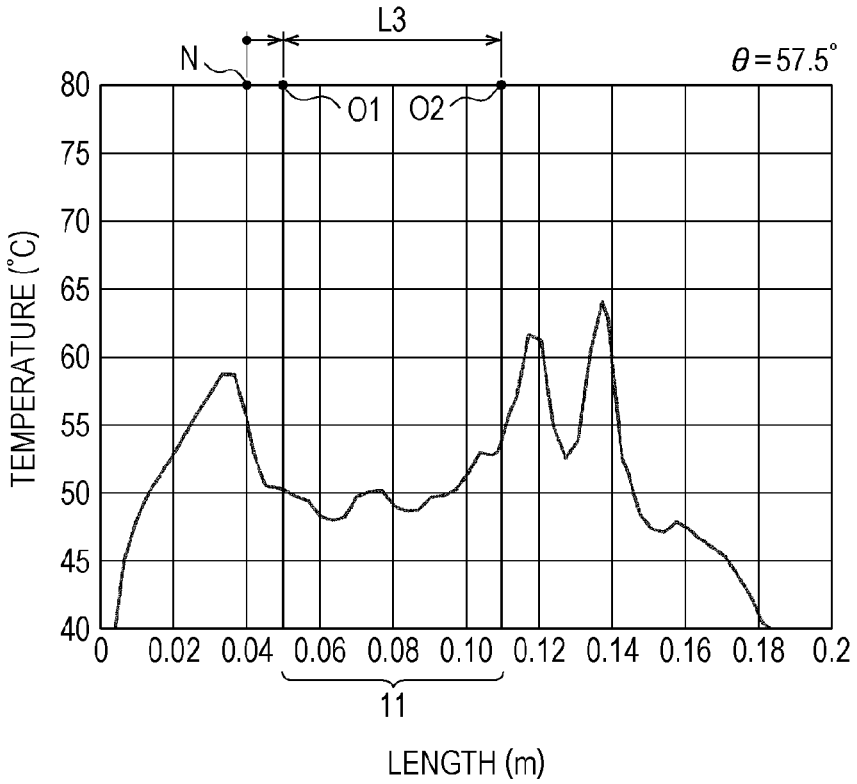
FIG. 8 is a graph representing the relationship between the feed length of the medium and the temperature distribution of the medium at the time of lowering the tilt angle of the irradiation unit by 5 degrees from the initial value, as above.

Next, when the tilt angle θ of the first electromagnetic wave A is set to 57.5 degrees lowering by 5 degrees from the initial value, the temperature distribution of the medium M within the liquid ejection region 11 is from approximately 48 degrees to approximately 54 degrees, as shown in FIG. 8, and the variation of the temperature distribution of approximately 6 degrees, is confirmed.

Figure 9:
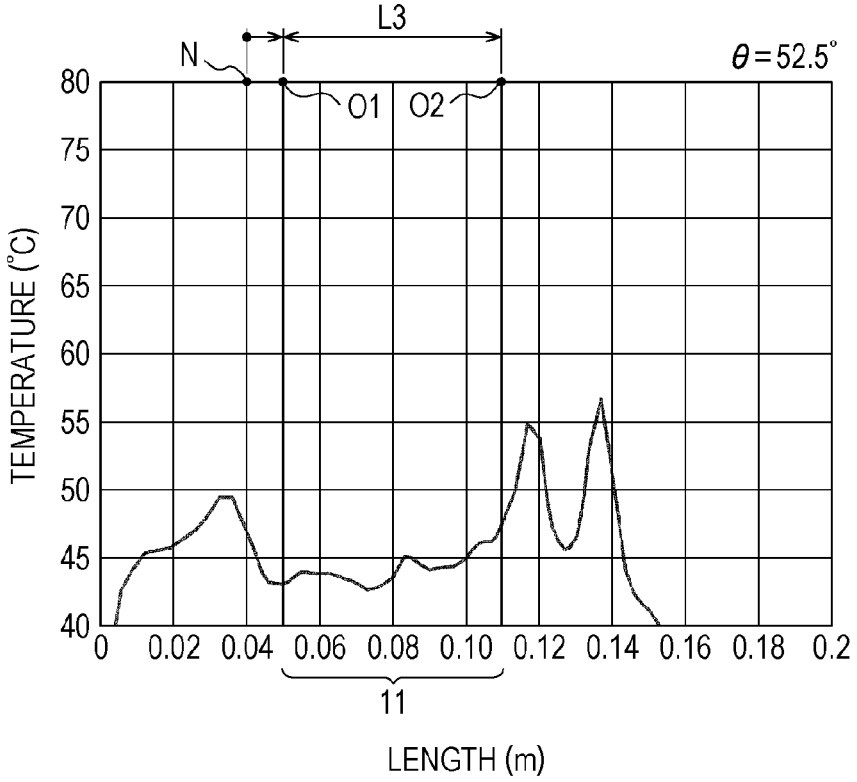
FIG. 9 is a graph representing the relationship between the feed length of the medium and the temperature distribution of the medium at the time of lowering the tilt angle of the irradiation unit by 10 degrees from the initial value, as above.

Furthermore, when the tilt angle θ of the first electromagnetic wave A is set to 52.5 degrees lowering by 10 degrees from the initial value, the temperature distribution of the medium M within the liquid ejection region 11 is from approximately 42.5 degrees to approximately 47 degrees, as shown in FIG. 9, and the variation of the temperature distribution of approximately 4.5 degrees, is confirmed.

As seen clear from the inspection results, if the tilt angle θ of the first electromagnetic wave A is lowered (the tilt with respect to the support face 5, is made to be gently inclined), the variation of the temperature distribution of the medium M is reduced, and, on the other hand, the temperature of the medium M is lowered, and then, thermal efficiency is reduced.

Accordingly, in the state of securing the thermal efficiency which is necessary for the drying, by finding out the condition of making the variation of the temperature distribution as small as possible, it is necessary to set the tilt angle θ of the first electromagnetic wave A.

(4) Operation Aspect of Liquid Ejecting Apparatus, see FIG. 2 and FIG. 3

Next, the operation of the liquid ejecting apparatus 1 according to Embodiment 1 to be configured described above, will be specifically described, on the basis of the drawings.

The medium M which is supplied to the medium transport path 15, gains a transport force by being pinched between the nip rollers 27, and is sent to the liquid ejection region 11 on a downward side of the ejection head 19. The medium support unit 7 is positioned on the downward side of the liquid ejection region 11, and by the support face 5 of the medium support unit 7, the medium M is supported almost in a horizontal posture.

If the medium M is supplied to the liquid ejection region 11, the ink as an example of the liquid L, is ejected toward the medium M on the support face 5 from the ejection head 19 on the upward side, and thereby, a desired recording is executed.

Moreover, the carriage 23 reciprocates in the width direction X in conjunction with the ejection of the ink, and thereby, the recording in the width direction X of the medium M is performed. The medium M is sent toward the downstream side in the transport direction Y by receiving the transport force which is given from the nip rollers 27, and thereby, the recording in the transport direction Y of the medium M is executed.

Furthermore, in Embodiment 1, the irradiation unit 9 and the blowing unit 29 extending so as to cover the entire range in the width direction X of the medium M, and a plurality of the sensors 13 which are arranged in the width direction X, are arranged. The first electromagnetic wave A by the irradiation unit 9, is irradiated to the region where the carriage 23 is not present by moving in the width direction X in the liquid ejection region 11. The heating of the medium M and the drying of the liquid L are executed, by the heating with the irradiation of the first electromagnetic wave A, and the wind W which is blown from the blowing unit 29. Therefore, the measurement of the temperature of the medium M is executed at the same time, by detecting the second electromagnetic wave B which is emitted from the heated medium M, by the sensor 13.

At this time, in the irradiation region AR of the first electromagnetic wave A which is irradiated from the irradiation unit 9, the distribution of the irradiation energy E of the first electromagnetic wave A, occurs as shown in FIG. 2, and the first electromagnetic wave A reaching the medium M at the peak spot P where the irradiation energy E peaks, becomes the regular reflection component A1, and advances in the direction which is shown by the arrow in the drawing.

However, in Embodiment 1, since the position of the sensor 13 is arranged in the position where the regular reflection component A1 of the first electromagnetic wave A is not detected reflected at the peak spot P as seen clear from the drawing, it is possible to accurately measure the temperature of the medium M, by detecting the second electromagnetic wave B without receiving the influence of the regular reflection component A1.

Moreover, in Embodiment 1, since the detection face of the sensor 13 is arranged so as to face the front with respect to the irradiation region AR as seen clear from the drawing, if the detection accuracy of the sensor 13 becomes extremely good, and the length L2 in the transport direction Y of the detection range 31 of the sensor 13 is approximately 20 mm, a moderate range is covered, and thus, the configuration which is less likely to receive the influence of the variation of the temperature of the medium M in the transport direction Y, is made.

Consequently, according to the liquid ejecting apparatus 1 relating to Embodiment 1, it is possible to accurately detect the second electromagnetic wave B which is emitted from the medium M, by reducing the influence of the reflection component of the first electromagnetic wave A which is irradiated from the irradiation unit 9. That is, it is possible to suppress the unevenness in the heating with respect to the medium M by the first electromagnetic wave A, by accurately performing the temperature measurement of the medium M, and accordingly, it is possible to realize the appropriate drying of the liquid L. Furthermore, it is possible to provide the compact liquid ejecting apparatus 1 by preventing the enlargement of the product size.

Figure 10:
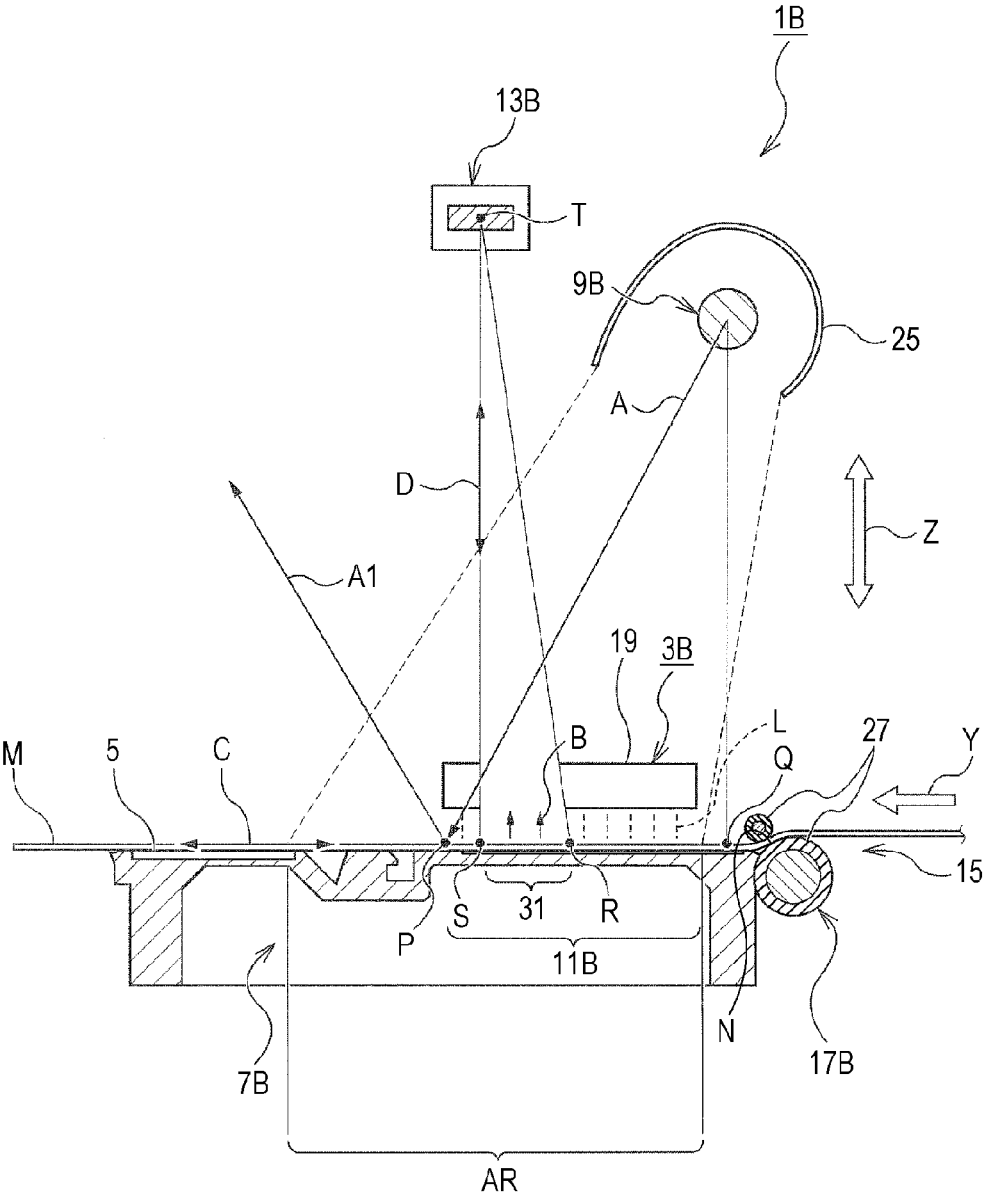
FIG. 10 is a side cross-sectional view schematically representing a positional relationship between each of configuration members of a liquid ejecting apparatus according to Embodiment 2 of the invention.

Embodiment 2, see FIG. 10

Next, a liquid ejecting apparatus according to Embodiment 2 of the invention which is different from Embodiment 1 in the arrangement configuration of the irradiation unit 9 and the sensor 13, will be described.

A liquid ejecting apparatus 1B according to Embodiment 2, is configured to include an ejection unit 3B, a medium support unit 7B, an irradiation unit 9B, a liquid ejection region 11B, a sensor 13B, and a transport unit 17B, in the same manner as the liquid ejecting apparatus 1 according to Embodiment 1 described above.

Therefore, the arrangement with respect to the ejection unit 3B of the irradiation unit 9B, and the arrangement with respect to the irradiation unit 9B of the irradiation region AR, are contrary to the arrangements in the liquid ejecting apparatus 1 according to Embodiment 1.

Specifically, the position Q in the first direction C of the irradiation unit 9B, is positioned on the upstream side in the transport direction Y of the medium M, with respect to the position R in the first direction C of the ejection unit 3B, and the irradiation region AR of the first electromagnetic wave A is positioned on the downstream side in the transport direction Y of the medium M, with respect to the position Q in the first direction C of the irradiation unit 9B. Furthermore, the position R in the first direction C of the ejection unit 3B, is the center point in the first direction C of the ejection unit 3B. Since other structures are similar to the structure of Embodiment 1, the same reference signs are attached to the same portions, and the description thereof is omitted.

Therefore, the same operation and effect as that of the liquid ejecting apparatus 1 according to Embodiment 1, are exhibited by the liquid ejecting apparatus 1B according to Embodiment 2 which is configured in this manner. Moreover, according to Embodiment 2, the first electromagnetic wave A which is irradiated from the irradiation unit 9B, can be used to both preheating of the medium M before the liquid L is ejected, and the drying of the liquid L.

Furthermore, in Embodiment 2, in the upward position in the height direction Z, the drying fan as the blowing unit 29 may be arranged. Specifically, the upward position is the position which is more upward than the carriage 23 in the height direction Z. Additionally, the blowing unit 29 has the role promoting the drying of the liquid L which is ejected to the medium M, by making the wind W flow with respect to the irradiation region AR in the width direction X, other than the region where the carriage 23 reciprocating is present within the irradiation region AR. Moreover, in a portion where the ejection unit 3B is present on an upward side in the irradiation region AR, the wind W which is blown from the blowing unit 29, is inhibited.

Accordingly, it is possible to decrease the occurrence of the deviation or the like of the landing position caused by the blowing of the liquid L which is ejected from the ejection unit 3B. Here, the term in which the wind W is inhibited, means that the wind W is completely blocked, or the air volume is decreased. Furthermore, if the blowing unit 29 blows the wind W with respect to the irradiation region AR, the installation location of the blowing unit 29, and the direction of the wind W may be any direction. For example, it may be configured to blow the wind W toward the upstream side from the downstream side in the transport direction Y.

Other Embodiments

The liquid ejecting apparatus 1 according to the invention, not only is basically configured by having the configuration as described above, but also is configured by performing modification or omission of the partial configuration within the range without departing from the gist of the invention.

For example, in Embodiment 1 described above, by arranging the sensor 13 in the position which is very close to the irradiation unit 9 side from the peak spot P, the influence of the reflection component of the first electromagnetic wave A which is irradiated from the irradiation unit 9, is reduced, but, in addition to the configuration, or in place of the configuration, by making the tile angle θ with respect to the support face 5 of the first electromagnetic wave A which is irradiated from the irradiation unit 9, as small as possible, it is possible to reduce the influence of the reflection component of the first electromagnetic wave A.

Furthermore, the detection range 31 of the sensor 13 which is shown in FIG. 2, FIG. 4, and FIG. 5, can be properly adjusted within the range of the liquid ejection region 11. In this case, for example, it is possible to make so as to use by enlarging the numbers of the channels in use which are shown in FIG. 4, in the sensor 13, by one more line of the upward side.

Moreover, numerical values which are exemplified in the description of the liquid ejecting apparatus 1 according to Embodiment 1, are used as an example, and can be properly adjusted according to the size of the liquid ejecting apparatus 1, the kind of the used medium M, or the like.

The entire disclosure of Japanese Patent Application No. 2013-240059, filed Nov. 20, 2013 is expressly incorporated reference herein.

What is claimed is:

1. A liquid ejecting apparatus comprising:

a medium support unit that has a support face supporting a medium to which a liquid is ejected;

an irradiation unit that irradiates the medium with a first electromagnetic wave from an oblique direction with respect to the support face; and a sensor that determines a temperature of the medium by detecting a second electromagnetic wave which is emitted from an irradiation region of the first electromagnetic wave on the support face, a detection face of the sensor not being inclined with respect to the support face, wherein the sensor is in a position with respect to the irradiation unit which is the same side as an irradiation direction of the first electromagnetic wave, and is arranged in a position where a regular reflection component of the first electromagnetic wave reflected at a peak spot where irradiation energy of the first electromagnetic wave peaks in the irradiation region is not detected, wherein the sensor is positioned such that an influence of a reflection component of the first electromagnetic wave on the temperature determined by the sensor is reduced.

2. The liquid ejecting apparatus according to claim 1, wherein the sensor is arranged between the irradiation unit and the peak spot.

3. The liquid ejecting apparatus according to claim 1, further comprising:

a transport unit that transports the medium toward a downstream side from an upstream side in a transport direction of the medium, wherein the irradiation unit is positioned on the downstream side in the transport direction with respect to an ejection unit, and the irradiation region of the first electromagnetic wave is positioned on the upstream side in the transport direction from the irradiation unit.

4. The liquid ejecting apparatus according to claim 1, further comprising:

a transport unit that transports the medium toward a downstream side from an upstream side in a transport direction of the medium, wherein the irradiation unit is positioned on the upstream side in the transport direction with respect to an ejection unit, and the irradiation region of the first electromagnetic wave is positioned on the downstream side in the transport direction from the irradiation unit.

5. The liquid ejecting apparatus according to claim 1, wherein the ejection unit ejects the liquid while reciprocating in a direction intersecting with the transport direction, and wherein the liquid ejecting apparatus further comprises a blowing unit that blows a wind with respect to the irradiation region of the first electromagnetic wave on the support face.

6. The liquid ejecting apparatus according to claim 1, wherein a detection face of the sensor is arranged so as to face a front with respect to the irradiation region of the first electromagnetic wave.

7. The liquid ejecting apparatus according to claim 1, wherein the sensor has a viewing angle which is 6 degrees to 7 degrees, and has a distance to the support face which is 150 mm or less in a second direction orthogonal to the support face.

8. The liquid ejecting apparatus according to claim 1, wherein the irradiation unit has a distance to the support face which is in a range of 80 mm to 110 mm in the second direction orthogonal to the support face.

* * * * *